US005394796A

United States Patent [19]

Jones et al.

[11] Patent Number: 5,394,796

[45] Date of Patent: Mar. 7, 1995

[54] SCREEN PROCESS WITH VARIABLE COATING THICKNESS CAPABILITY

[75] Inventors: Wallace R. Jones, Waite Hill Village; Salvatore Ferro, Sagamore Hills; Robert A. Isaksen, Chardon, all of Ohio

[73] Assignee: The Excello Specialty Company, Cleveland, Ohio

[21] Appl. No.: 279,782

[22] Filed: Jul. 25, 1994

[51] Int. Cl.[6] ..... B41M 1/12; B41F 15/20; B41L 13/12

[52] U.S. Cl. ..... 101/129; 427/272; 427/282; 101/126

[58] Field of Search ..... 101/114, 126, 129; 427/272, 275, 276, 282; 428/187

[56] References Cited

U.S. PATENT DOCUMENTS

| | | | |
|---|---|---|---|
| 3,868,214 | 2/1975 | Shackleton | 101/129 |
| 4,033,831 | 7/1977 | Bakewell | 204/11 |
| 4,324,815 | 4/1982 | Mitani et al. | 427/96 |
| 4,542,691 | 9/1985 | Kokrhanek | 101/129 |
| 4,709,631 | 12/1987 | Davey et al. | 101/129 |
| 4,771,687 | 9/1988 | Daunheimer | 101/129 |
| 4,791,006 | 12/1988 | Galvagni et al. | 427/282 |
| 4,813,351 | 3/1989 | Pierson, Jr. | 101/115 |
| 4,930,413 | 6/1990 | Jaffa | 101/126 |
| 4,958,560 | 9/1990 | Collins | 101/129 |
| 5,240,816 | 8/1993 | Noguchi et al. | 101/129 |

FOREIGN PATENT DOCUMENTS

| | | | |
|---|---|---|---|
| 2366 | 1/1985 | Japan | 101/129 |

*Primary Examiner*—Edgar S. Burr
*Assistant Examiner*—Stephen R. Funk
*Attorney, Agent, or Firm*—Fay, Sharpe, Beall, Fagan, Minnich & McKee

[57] ABSTRACT

A method of applying a flowable printing fluid in a predetermined pattern of predetermined thickness to a flexible air impervious sheet comprises providing a vacuum table and overlying the table with a template having a thickness at least substantially as great as the thickness of printing fluid desired to be applied. The template has openings defining the predetermined pattern formed therethrough so that the table is exposed through the template throughout the predetermined pattern. The flexible sheet to which the predetermined pattern of printing fluid is to be applied is placed over the table and template so that the pattern formed in the template is aligned with the sheet in the desired location. A vacuum is pulled on the vacuum table to cause the flexible sheet to be drawn down into the template through the openings defining the predetermined pattern. Then, the flexible sheet is overlaid with a printing screen having open printing areas overlying and generally corresponding to the template openings forming the predetermined pattern. Thereafter, the flowable printing fluid is squeegeed through the open printing areas of the printing screen and onto the portions of the flexible sheet drawn down into the openings in the template.

17 Claims, 3 Drawing Sheets

SCREEN PROCESS WITH VARIABLE COATING THICKNESS CAPABILITY

BACKGROUND OF THE INVENTION

The subject invention is directed toward a screen printing method which allows the printing fluid to be applied in selected variable thicknesses.

The method is especially suited for applying patterns of adhesive to plastic sheets used for door protectors in the automotive industry and will be described with reference thereto; however, the invention is capable of broader application and could be used for applying many types of paints, adhesives, and the like in predetermined patterns to a variety of different sheet materials used for many purposes.

In commonly assigned U.S. Pat. Nos. 4,588,627; 4,865,791; 4,696,848; and 4,873,132, there are disclosed protective plastic sheet devices commonly used in the automotive industry as water deflectors or shields for the interior of passenger compartment doors. The water deflector sheets are generally held in place by pressure sensitive adhesive applied to the sheets in predetermined patterns by, for example, a screen printing process. Depending on various factors, including the shape and nature of the shield, as well as the shape and nature of the door interior surface to which the shield is to be applied, it has at times been desirable to coat the adhesive in thicker layers in some areas. Such application of the adhesive has not been possible using normal screen printing techniques of the type generally used for adhesive application.

SUMMARY OF THE INVENTION

The subject invention provides a method of applying materials such as pressure sensitive adhesive in predetermined patterns of varying thickness using screen process printing techniques. In accordance with the subject invention, a method of applying flowable adhesive in a predetermined pattern to a flexible sheet generally comprises the steps of providing a vacuum table and overlying the table with a template having a thickness at least substantially as great as the thickness of adhesive desired to be applied. The template is provided with through openings that define the predetermined pattern so that the table is exposed throughout the template in the areas of the predetermined pattern. The flexible plastic sheet to which the predetermined pattern of adhesive is to be applied is placed over the table and the template so that the pattern formed in the template is aligned with the plastic sheet in the desired locations. Thereafter, a vacuum is pulled on the vacuum table to cause the plastic sheet to be drawn down into the template through the openings defining the predetermined pattern and into general engagement with the table throughout these areas. The plastic sheet is then overlaid with the printing screen which has open printing areas arranged to overlie and generally correspond to the template openings formed in the predetermined pattern. Thereafter, the flowable adhesive is squeegeed through the open printing areas of the printing screen and onto the portions of plastic sheet drawn down into the openings in the template. Preferably, and in accordance with a more limited aspect of the invention, the open areas of the printing screen are formed larger than the openings defining the predetermined pattern so that the adhesive has thick portions in the predetermined pattern and thinner portions adjacent thereto. This, of course, causes the adhesive to deposit in both the areas of the sheet drawn down into the openings in the template as well as on the surrounding areas that are supported on the template. Thus, the adhesive application is in two thicknesses with a central heavy thick area and adjacent thinner areas.

In accordance with yet another and more limited aspect of the invention, the template is preferably formed to extend laterally outwardly from the predetermined pattern in amounts sufficient to assure that the open printing areas in the printing screen are entirely underlaid by template and openings defining the predetermined pattern.

In accordance with a still further aspect of the invention, it is preferred that the openings in the template be formed to have a relatively narrow sinusoidal shape such that the printing screen is not forced down into the template openings during this squeegeeing step. That is, the squeegee is supported by underlying portions of template at all times during its traverse of the printing screen. The use of the sinusoidal or irregular shape in the patterns acts to support the squeegee at spaced locations transversely across the screen during squeegee movement.

As can be appreciated, the patterns can be laid out as desired so that the thickness application of adhesive or other materials is assured in those areas where it is desired. By varying the thickness of the template, the thickness of the application can also be varied. This greatly expands the use of screen printing techniques when heavier applications of material are desired or when a particular thickness and arrangement of such materials must be achieved.

As can be seen from the foregoing, the primary object of the invention is the provision of a screen printing method which allows various thicknesses of printed fluid to be applied at desired locations across a sheet.

Still another object is the provision of a method of the type described which is particularly suitable for applying adhesive to protective sheets used in vehicle door construction.

Yet another object is the provision of a method of the type described wherein the flowable material can be applied to the sheet in any desired pattern of varying thicknesses.

A still further object is the provision of a method of the type described which can use basically conventional screen printing equipment to achieve the variable thickness application of the printing fluids.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
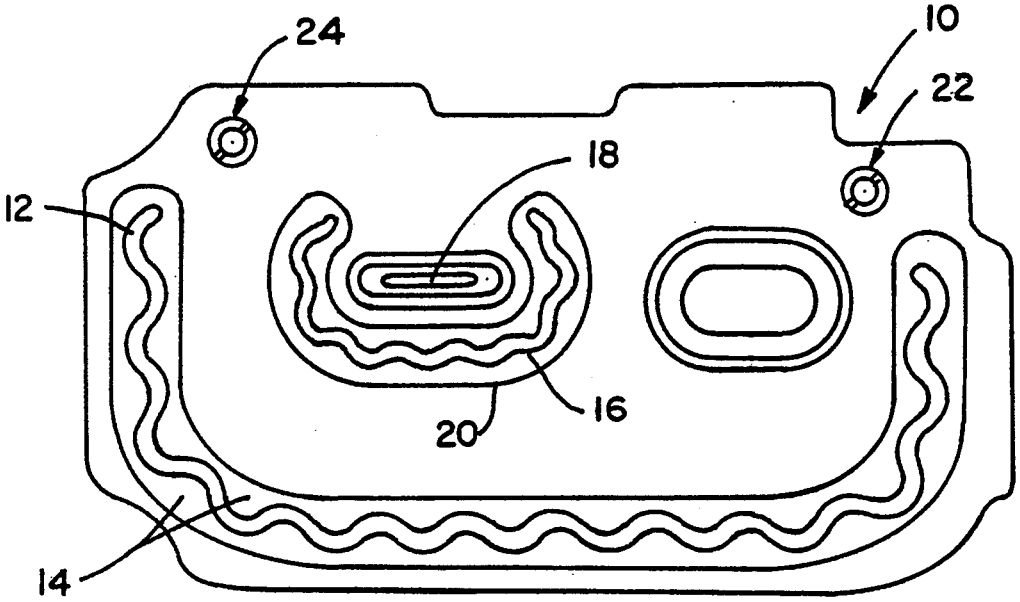
FIG. 1 shows a protective door panel sheet with adhesive applied thereto in desired patterns of varying thickness.

Referring more particularly to the drawings wherein the showings are for the purpose of illustrating the preferred embodiment of the invention only and not for the purpose of limiting same, the overall arrangement and use of the method for printing a predetermined pattern of adhesive to a protective plastic sheet of the type used as an inner door water deflector or protector in vehicle construction can be best understood by reference to FIG. 1 which illustrates such a protective door panel in a typical form. The door panel protective sheet 10 of FIG. 1 generally comprises a sheet of relatively thin flexible plastic material such as polyethylene, polypropylene, polyvinyl chloride, or the like. The sheet has a peripheral shape which corresponds to the desired shape of the area within the door to be protected. The interior areas of the sheets may be provided with openings for the passage of various door operating mechanisms, wiring, and the like. Additionally, the panels may be provided with deflectable pocket-like areas formed in accordance with the teachings of U.S. Pat. Nos. 4,696,848; 4,873,132; and 4,865,791 to allow the plane of the sheet to be deflected laterally for passing over irregularities in the protected surface or to accommodate internal door mechanisms. These features of the sheet are not important in the understanding of the subject method. It is, to be understood, that the adhesive must be applied to various areas on the sheet to allow it to be firmly mounted in position.

In the FIG. 1 showing, adhesive is applied along both lateral side edges and across the bottom in a continuous sinusoidal pattern 12 with thinner applications in areas 14 on both sides of the thicker sinusoidal pattern. For example, in the thicker central sinusoidal application area 12, the thickness of the adhesive might be in the range of 0.003 inches while in the areas identified as 14 the adhesive might be only of a thickness in the range of 0.001 inches. In any event, the thicker adhesive application might, for example, be necessary to hold a heavier sheet in position on an irregular and rough textured surface. A similar arrangement is shown in area 16 which surrounds a small deflected pocket area 18. That is, the thick sinusoidal application shown and identified with the numeral 16 is surrounded by a thinner area 20. Likewise, for example, two spots of thick application 22 and 24 can be provided to permit these areas to function as original thumb-type positioning or adhering areas to allow the sheet to be positioned during installation by merely pressing these two areas 22 and 24 into engagement on the interior of the door panel while the remaining portions are adjusted into final located position and adhered using the remaining adhesive areas 12 and 16.

Figure 2:
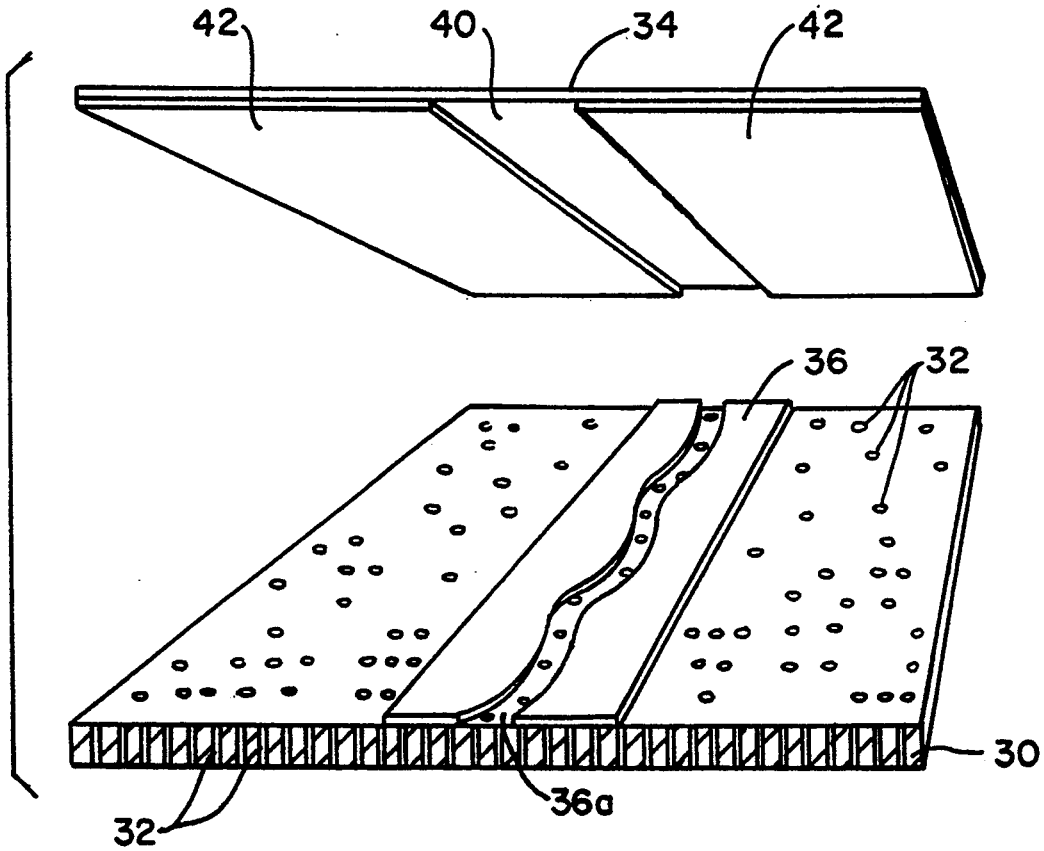
FIG. 2 is a pictorial view illustrating the basic elements used in the practice of the subject method.

Referring more particularly to FIGS. 3A through 3E, the overall preferred procedure for practicing the subject method can best be understood. Basically, as shown in FIG. 2, the subject method makes use of a conventional vacuum table 30 which is merely a planar table surface provided with a multiplicity of relatively closely spaced and uniformly distributed vacuum holes 32 throughout its surface. The underside of the table is, of course, connected with a vacuum source so that the vacuum is drawn through the holes 32 across the entire surface of the table. A conventional printing screen through which the printing fluid is squeegeed is shown at 34. Although not specifically shown, some associated structure is provided so that the screen can be brought down into operative engagement relative to the top surface of the table and removed therefrom as desired.

In the practice of the subject method, a template 36 is provided over the top of the table to form the desired patterns of fluid application. As shown in FIG. 2, the template 36 is a layer of sheet material which can be porous, selected to have a thickness greater than 5 mils and at least as thick as the desired thickness of the adhesive application. The template 36 is cut out and arranged in the patterns shown in FIG. 1 for which the adhesive is to be applied. Note that in the FIG. 1 showing, the sinusoidal application strip 12 would correspond to the shape and arrangement of the opening through template 36. A second template for strip 16 would also be applied and located on the table at the respective desired location to correspond to the printing application to take place onto the protective sheet. As will become apparent hereinafter, the application or printing strips 12 and 16 do not have to be sinusoidal but this is generally preferred for reasons which will subsequently become apparent. In addition, the template can have cutout portions in areas where no printing is to take place provided the printing screen is blocked out in those areas. The additional open non-printing areas further assure that the sheet is firmly held in position during printing.

Arranged to cooperate with the template and provided with an open print area 40 is the previously-mentioned screen 34. As can be seen, the screen is blocked out, as is well understood, in those areas in which application is not to take place. Specifically, areas 42 are blocked out and made impervious to the flow of the printing fluid, i.e., the pressure sensitive adhesive. Areas 40, however, are open print areas and arranged to overlie the template 36 and its open center groove **36*a*. The arrangement described with respect to FIG. 2 is seen in cross section in FIG. 3A which shows the screen 34 immediately above the print table 30** but without the sheet of plastic on which the printing is to take place.

Figure 3A:
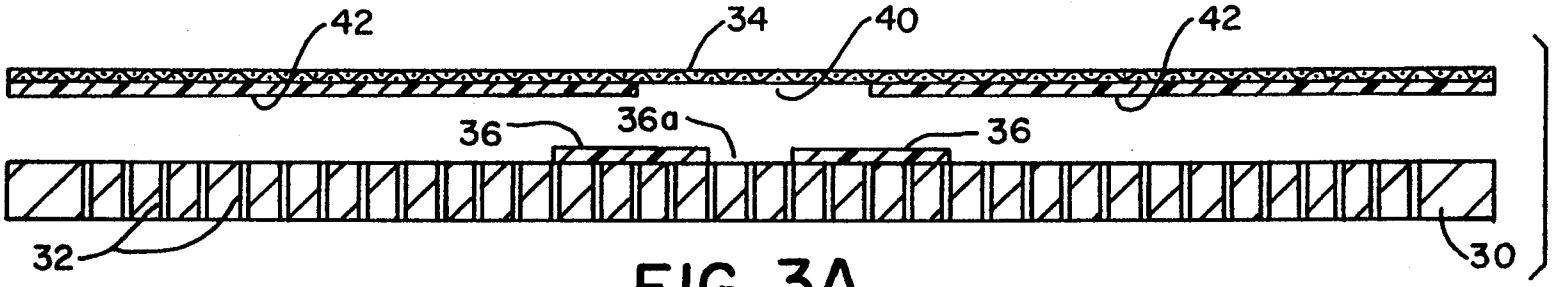
FIG. 3A is a transverse cross-sectional view through a printing table and screen arranged to practice the subject method.
Figure 3B:
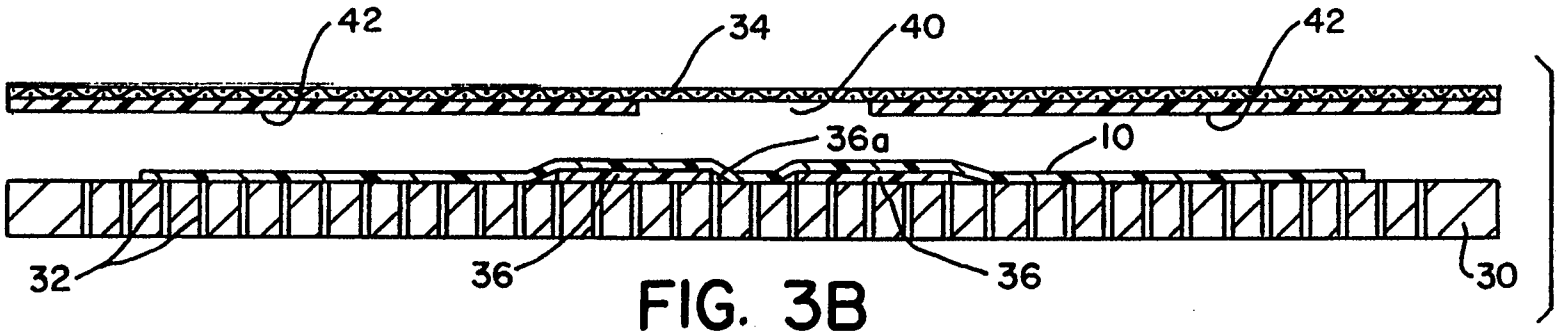
FIG. 3B is a view like FIG. 3 but showing the material on which the printing is to take place in position on the vacuum table.

Preparatory to printing, a plastic sheet having the characteristics desired for use as a protective sheet is moved into position on the vacuum table and aligned so that the template areas are properly in position at the locations to which it is desired to apply the adhesive. Thereafter, the vacuum table is actuated and a vacuum drawn. FIG. 3B shows the components with the plastic sheet in position. The sheet is identified with the numeral 10 and is pulled down into firm engagement with the table by the vacuum. Note that sheet 10 is pulled down in all areas adjacent the template 36 and including the center cutout sinusoidal area **36*a***.

Figure 3C:
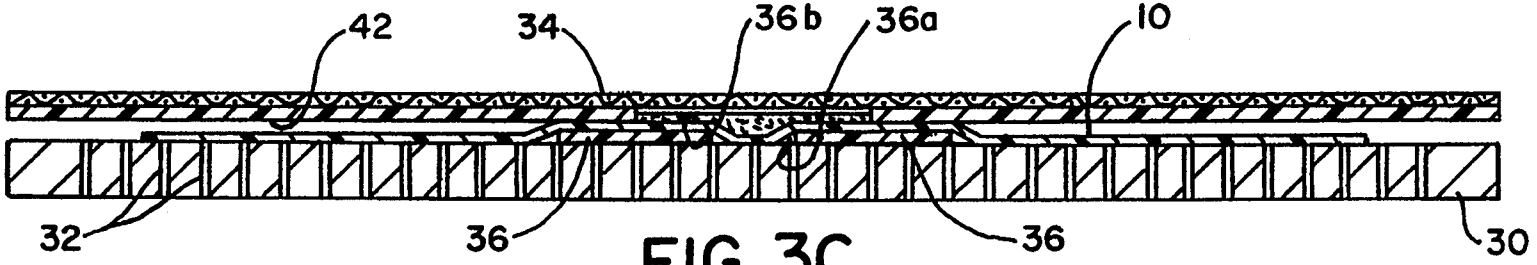
FIG. 3C is a view like FIGS. 3A and 3B but showing the various components in engaged position with the adhesive squeegeed into position between the screen and the printing table.

FIG. 3C shows the screen in printing contact engagement with the top surface of plastic sheet 10. The adhesive is squeegeed through the screen in the open area 40 and deposits on the plastic sheet and enters into and fills the depressed sheet portion in the cutout template area **36*a* as shown. The adhesive is thus substantially thicker in the cutout. This thicker central area is provided on each side with a thinner side area identified as 36***b* in FIG. 3C. It should be appreciated that this thickness can be substantially varied by varying the thickness of the template or by applying plural template layers in certain areas.

Figure 3D:
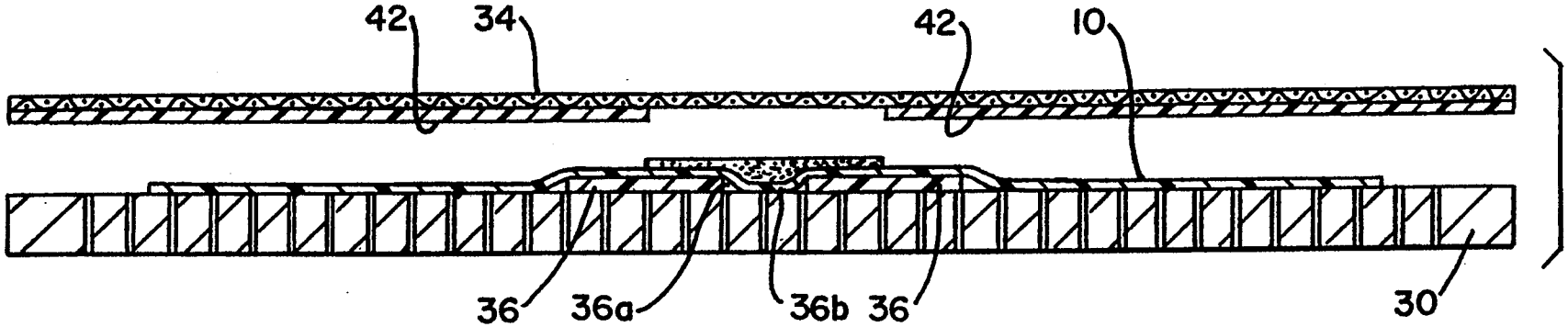
FIG. 3D shows the arrangements of FIGS. 3A through 3C in separated position with the vacuum and the vacuum table still on but the screen lifted in preparation for removal of the sheet; and, FIG. 3E shows the sheet after completion of the printing and with the vacuum off.
Figure 3E:
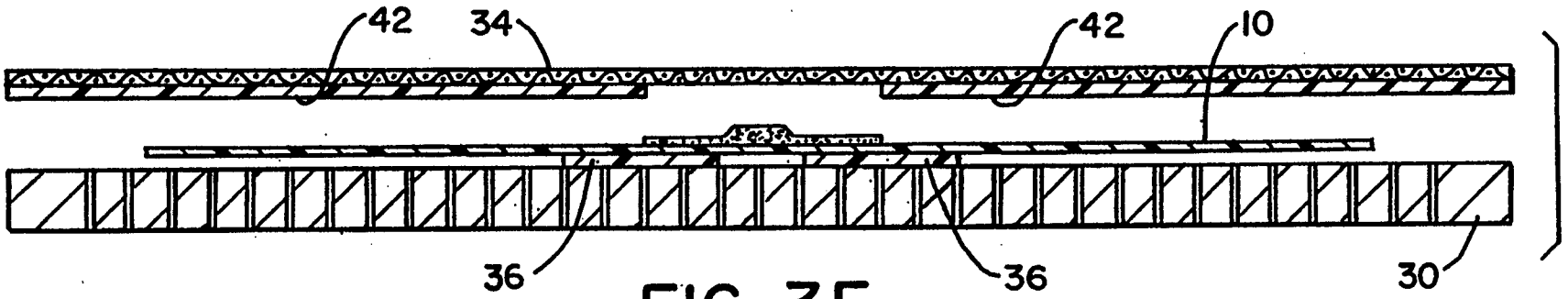

FIGS. 3D and 3E show the screen lifted following the squeegeeing operation with 3D showing the vacuum table still in the energized vacuum on position and 3E showing the table in the de-energized position with the vacuum off so that the printed sheet can be removed.

As previously mentioned, the thicker areas are shown in the preferred embodiment as sinusoidal paths. The sinusoidal path is preferred since it assures that the squeegee cannot drop into cutout areas that happen to be parallel to the squeegee. Specifically, area 36 which results from the pattern in the template is arranged so that it will always support the squeegee at at least spaced positions and prevent it from entering into and clearing the thicker adhesive application from within the groove. This could also be achieved by applying the thicker adhesive in other patterns or individual small closely placed spots rather than a continuous line. The actual method selected to prevent the squeegee from entering the printed groove could vary depending upon the surrounding circumstances and the need for adhesive application in any particular instance.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A method of applying flowable adhesive in a predetermined pattern to a flexible sheet comprising the steps of:

a) providing a vacuum table;

b) overlying the table with a template having a thickness at least substantially as great as the thickness of adhesive desired to be applied, the template having openings defining the predetermined pattern formed therethrough so that the table is exposed through the template throughout the predetermined pattern;

c) placing the flexible sheet to which the predetermined pattern of adhesive is to be applied over the table and template so that the pattern formed in the template is aligned with the sheet in the desired location;

d) pulling a vacuum on the vacuum table to cause the sheet to be drawn down into the template through the openings defining the predetermined pattern;

e) overlying the sheet with a printing screen having open printing areas overlying and generally corresponding to the template openings forming the predetermined pattern; and, f) thereafter squeegeeing the flowable adhesive through the open printing areas of the printing screen and onto the portions of the sheet drawn down into the openings in the template.

2. The method as defined in claim 1 wherein the vacuum is drawn on the table throughout the time the adhesive is squeegeed through the open areas of the printing screen.

3. The method as defined in claim 1 wherein the open areas of the printing screen are larger than the openings defining the predetermined pattern and squeegeeing adhesive through the open areas to cause adhesive to deposit in both the areas of the sheet drawn down into the openings in the template as well as on surrounding areas supported on the template.

4. The method as defined in claim 1 wherein the template is joined to the table prior to pulling a vacuum.

5. The method as defined in claim 1 wherein the template is formed from a sheet of material of generally uniform thickness throughout.

6. The method as defined in claim 5 wherein the template is formed from a material which is air porous.

7. The method as defined in claim 6 wherein the template is made from plastic sheet having a thickness greater than 5 mils.

8. The method as defined in claim 6 wherein the template is formed to extend laterally outwardly from the predetermined pattern formed therein an amount sufficient to assure that the open printing areas in the printing screen are entirely underlaid by template and openings defining the predetermined pattern.

9. The method as defined in claim 1 wherein the openings in the template are formed to have a relatively narrow sinusoidal shape such that the printing screen is not forced down into the template openings during the squeegeeing step.

10. A method of applying a flowable printing fluid in a predetermined pattern of predetermined thickness to a flexible air impervious sheet comprising the steps of:

a) providing a vacuum table;

b) overlying the table with a template having a thickness at least substantially as great as the thickness of printing fluid desired to be applied, the template having openings defining the predetermined pattern formed therethrough so that the table is exposed through the template throughout the predetermined pattern;

c) placing the flexible sheet to which the predetermined pattern of printing fluid is to be applied over the table and template so that the pattern formed in the template is aligned with the sheet in the desired location;

d) pulling a vacuum on the vacuum table to cause the flexible sheet to be drawn down into the template through the openings defining the predetermined pattern;

e) overlying the flexible sheet with a printing screen having open printing areas overlying and generally corresponding to the template openings forming the predetermined pattern; and, f) thereafter squeegeeing the flowable printing fluid through the open printing areas of the printing screen and onto the portions of the flexible sheet drawn down into the openings in the template.

11. The method as defined in claim 10 wherein the vacuum is drawn on the table throughout the time the fluid is squeegeed through the open areas of the printing screen.

12. The method as defined in claim 10 wherein the open areas of the printing screen are larger than the openings defining the predetermined pattern and squeegeeing printing fluid through the open areas to cause printing fluid to deposit in both the areas of the sheet drawn down into the openings in the template as well as on surrounding areas supported on the template.

13. The method as defined in claim 10 including continuing to pull a vacuum on the table until after the squeegeeing step (f) is complete and the printing screen is removed from its position overlying the flexible sheet.

14. The method as defined in claim 10 wherein the template is formed from a sheet of material of generally uniform thickness throughout.

15. The method as defined in claim 10 wherein the template is formed from a material through which air can pass.

16. The method as defined in claim 10 wherein the template is formed to extend laterally outwardly from the predetermined pattern formed therein an amount sufficient to assure that the open printing areas in the printing screen are entirely underlaid by template and openings defining the predetermined pattern.

17. The method as defined in claim 10 wherein the openings in the template are formed to have a relatively narrow sinusoidal shape such that the printing screen is not forced down into the template openings during the squeegeeing step.

* * * * *